US008314823B2

(12) United States Patent
Gunabalan et al.

(10) Patent No.: US 8,314,823 B2
(45) Date of Patent: Nov. 20, 2012

(54) PRINTER AND METHOD OF PRINTING

(75) Inventors: Ranjithkumar Mukeri Gunabalan, Chennai (IN); Phani Kumar Vutukuri, Puducherry (IN); Raghul Sambathkumar, Tamilnadu (IN); Barrie Clark, Dundee (GB)

(73) Assignee: NCR Corporation, Duluth, GA (US)

( * ) Notice: Subject to any disclaimer, the term of this patent is extended or adjusted under 35 U.S.C. 154(b) by 404 days.

(21) Appl. No.: 12/647,000

(22) Filed: Dec. 24, 2009

(65) Prior Publication Data

US 2011/0157292 A1 Jun. 30, 2011

(51) Int. Cl.
*B41J 17/00* (2006.01)

(52) U.S. Cl. ..... 347/215

(58) Field of Classification Search ..... 347/215, 347/171, 173, 174, 104, 101; 400/611, 612, 400/613, 617; 271/225, 226
See application file for complete search history.

(56) References Cited

U.S. PATENT DOCUMENTS

| | | | | |
|---|---|---|---|---|
| 7,333,122 | B2 * | 2/2008 | Park et al. | 347/171 |
| 7,673,983 | B2 * | 3/2010 | Coenen et al. | 347/104 |
| 2002/0130941 | A1 * | 9/2002 | Tanaami | 347/104 |
| 2009/0185021 | A9 * | 7/2009 | Lyons et al. | 347/190 |

* cited by examiner

*Primary Examiner* — Kristal Feggins
(74) *Attorney, Agent, or Firm* — Paul W. Martin

(57) ABSTRACT

A printer comprises a moveable print head such that print elements of the print head are able to print to two streams of media having different physical locations.

23 Claims, 4 Drawing Sheets

FIG. 3a
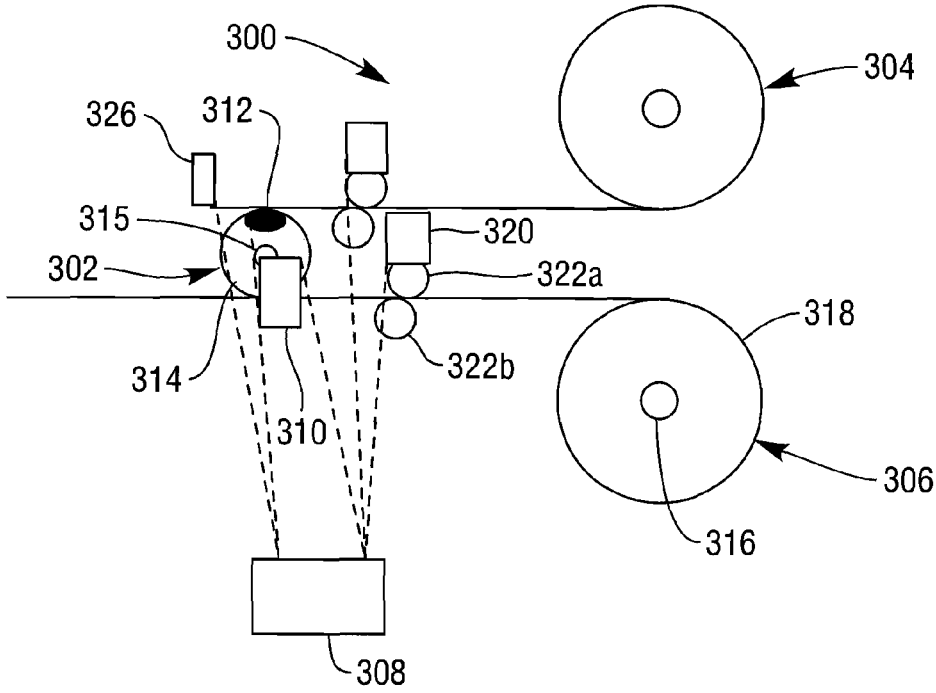
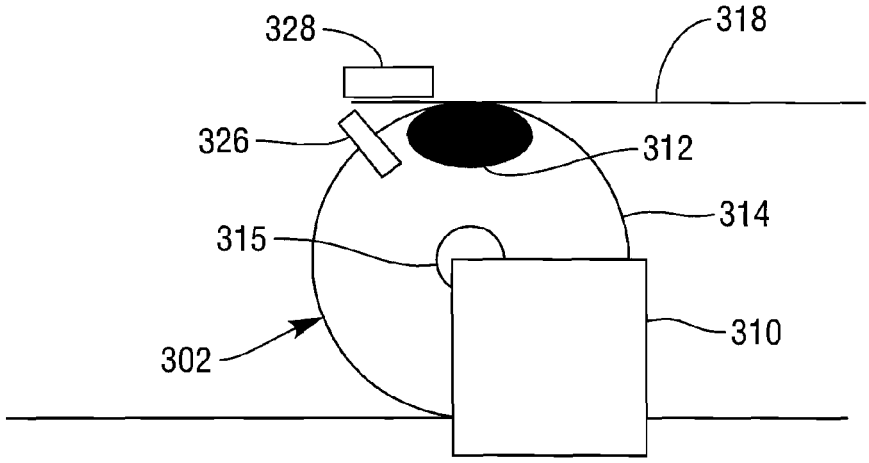
FIG. 3b

FIG. 3c
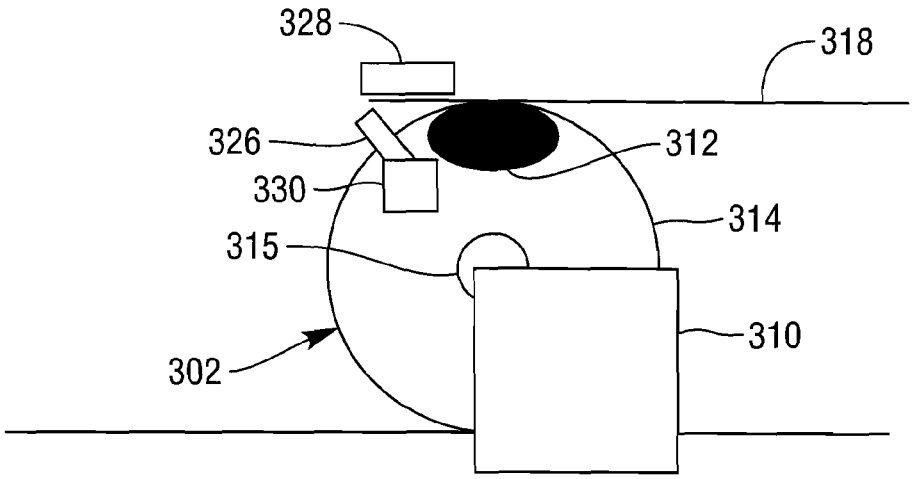
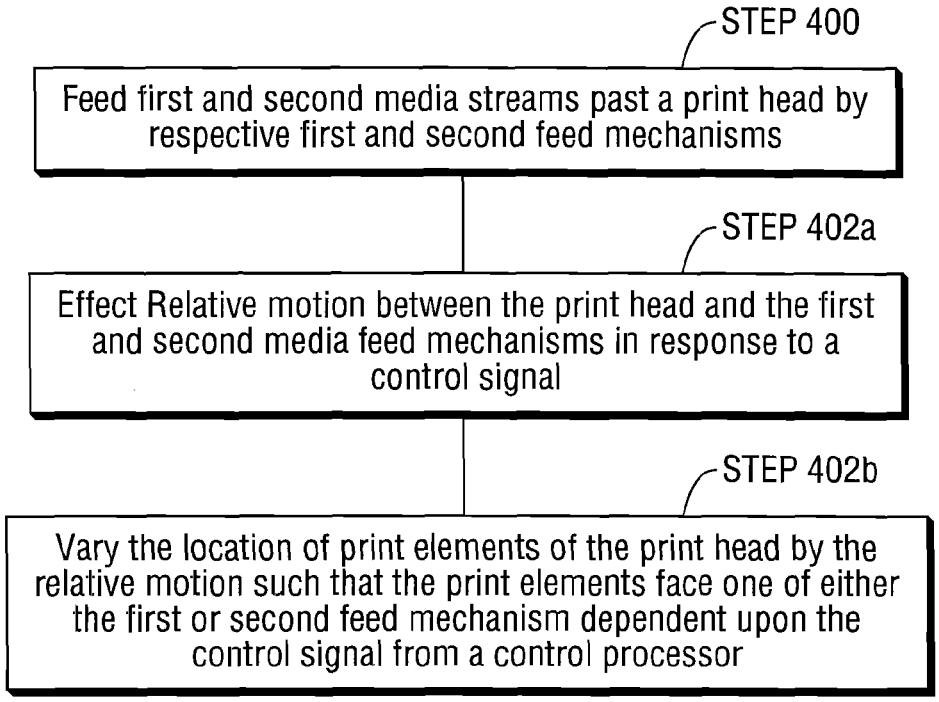
FIG. 4

PRINTER AND METHOD OF PRINTING

FIELD OF THE INVENTION

The present invention relates to a printer and a method of printing. More particularly, but not exclusively, this invention relates to a thermal printer having a single thermal print head operable to print to each of two streams of thermal print media and a method of thermal printing to each of two streams of thermal print media with a single thermal print head.

BACKGROUND TO THE INVENTION

Automated teller machines (ATMs) and other self-service terminals (SSTs) such as self-service retail checkouts, or check-in terminals for airlines, hotels or medical services, often print a receipt for a customer who has used them. In many instances, for example in an ATM, an internal journal printer logs each customer transaction with the terminal for audit purposes. Typically, the printers used for printing receipt and journal printing are thermal printers, with two sided thermal printers being used for printing of coupons, advertising and other information on the obverse side of customer receipt to the transaction receipt.

Typically, the journal printer and the receipt printer are discrete devices located separately within the SST. The provision of separate journal and receipt printers results in them occupying a large total volume within the SST, where such volume is at a premium and could be employed for other uses. Furthermore, as the journal and receipt printers are usually located away from each other the replenishment and servicing of them involves multiple access points and is labor intensive. Also, each printer will use duplicate common parts which add to the manufacturing complexity, failure modes and overall cost of the SST.

A difficulty associated with combining these printers is the conflicting requirement for a continuous stream of media for a journal in order to ensure an uninterrupted record of transactions for audit purposes, and the need to cut the receipt printer paper to allow a customer to take their receipt with them.

SUMMARY OF THE INVENTION

According to a first aspect of the present invention there is provided a printer comprising:

a print head comprising a body and print elements;

first and second media feed mechanisms arranged to feed respective first and second print media past the print head;

a processor arranged to control the print head and the first and second media feed mechanisms;

a selection mechanism arranged to effect relative motion between the print head body and at least one of the first and second media feed mechanisms in response to a signal from the processor; and the print elements being arranged to selectively face a respective feed path of either the first or second feed mechanism dependent upon the signal from the processor.

Such a printer allows both the receipt printer and the journal printer to be combined into a single unit. This reduces the volume occupied by these printers, allows a single point of access for maintenance and reduces the complexity and number of parts required to manufacture the printer.

The printer may comprise a thermal printer. The print head may comprise a thermal print head.

The printer may comprise a cutting device associated with the first media feed mechanism, wherein the cutting device is arranged to cut media fed through the first media feed mechanism transversely to the direction of feed of the first media feed mechanism, in response to a signal from the processor. Such a cutting device allows the selective cutting of, for example, receipts whilst leaving the, for example, printed journal media intact.

The first and second media feed mechanisms may be aligned such that the respective paths of media fed therethrough lie in a common plane parallel to the direction of feed of said media. The selection mechanism may comprise a drive mechanism arranged to drive the print head transversely to the feed paths between first and second positions corresponding to the first and second feed paths respectively.

The cutting device may be arranged to cut the media associated with the first feed path at a point in the first feed path after print head. This arrangement allows the media to remain under the control of the feed path past the feed path reducing the likelihood of media misfeed leading up to the print head.

The first and second media mechanisms may be aligned such that the respective paths of media fed therethrough lie in separate parallel planes which are also parallel to the direction of feed of said media. The first media feed path may be closer to the print head than the second media feed path.

The cutting device may be arranged to cut the media associated with the first feed path at a point in the first feed path prior the print head. This means that the first media, for example the receipt, will not interfere with printing of the second media, for example the journal, once it has been printed. The cutting device may be arranged to cut the media after the print head and once the media withdrawn.

The selection mechanism may comprise a displacement mechanism arranged to displace the second media feed path such that media fed along the second media feed path is adjacent the print elements.

The displacement mechanism may comprise a pivotally mounted arm having a support roller arranged to support media associated with the second media feed path at a free end thereof. The displacement mechanism may comprise a motor arranged to drive the arm between first and second positions in response to a signal from the processor, wherein in the first position the support roller is remote from the print head and in the second position the support roller is adjacent the print head. This arrangement allows a receipt to be printed and cut so that the print head is free to print the journal.

The print head may comprise a cylinder. The print elements may be aligned along a longitudinal axis of the body of the cylinder. The displacement mechanism may be arranged to rotate the cylinder such that the print elements are arranged to selectively face a respective feed path of either the first or second feed mechanism in response to the signal from the processor.

The cylinder may comprise a blade and the first media feed mechanism may comprise an anvil; the blade and anvil being arranged to cooperate to cut media passing along the first media feed mechanism at a defined point in the rotation of the cylinder. The blade may comprise a first sharp, cutting edge and a second blunt edge such that the blade is arranged to cooperate with the anvil to cut said media when the cylinder rotates in one direction only. The defined point in the rotation of the cylinder may be at a point in the first feed path after print head. The blade may be selectively, retractable in to the body of the cylinder, for example by means of a solenoid. Alternatively, or additionally, the blade may be spring mounted.

The printer may comprise a further print head located on the opposite side of the first media feed path to the print head.

The further print head may be arranged to print on the opposite side of media passing along the first media feed path to the print head.

The printer may comprise a yet further print head located on the opposite side of the second media feed path to the print head. The yet further print head may be arranged to print on the opposite side of media passing along the second media feed path to the print head.

The printer head may comprise a thermal print head, comprising thermal print elements and the media may comprise thermal paper. The thermal paper may comprise two sided thermal paper.

According to a second aspect of the present invention there is provided a self-service terminal comprising a printer according to the first aspect of the present invention.

The self-service terminal may comprise any of the following: an automated teller machine (ATM); an information kiosk; an electronic funds transfer (EFT) terminal a financial services centre; a video, DVD, multi-media, mpeg3 etc sales/rental kiosk; a bill payment kiosk; a lottery kiosk; a postal services machine; a check-in and/or check-out terminal such as those used in the retail, hotel, car rental, gaming, healthcare, and airline industries; or the like.

According to a third aspect of the present invention there is provided a method of printing on two streams of media comprising the steps of:

feeding first and second media streams past a print head by respective first and second feed mechanisms; and effecting relative motion between the print head and the first and second media feed mechanisms in response to a control signal so as to vary the location of print elements of the print head such that the print elements face one of either the first or second feed mechanism dependent upon the control signal from a control processor.

The method may comprise cutting the first media stream transversely to the direction of feed of the first media feed mechanism, in response to a signal from the processor.

The first and second media feed mechanisms may be aligned such that the respective paths of media fed therethrough lie in a common plane parallel to the direction of feed of said media. The method may comprise driving the print head transversely to the feed paths between first and second positions corresponding to the first and second feed paths respectively.

The method may comprise cutting the first media stream at a point in the first feed path after print head.

The first and second media mechanisms may be aligned such that the respective paths of media fed therethrough lie in separate parallel planes, which are also parallel to the direction of feed of said media. The first media feed path may be closer to the print head than the second media feed path.

The method may comprise cutting the media associated with the first feed path at a point in the first feed path prior the print head.

The method may comprise displacing the second media feed path such that media fed along the second media feed path is adjacent the print elements.

The method may comprise displacing the second media stream by pivoting an arm having a guide which supports the second media stream at a free end thereof. The method may comprise driving the arm between first and second positions by a motor in response to a signal from the processor, wherein in the first position the guide is remote from the print head and in the second position the guide is adjacent the print head. The guide may comprise a roller. The guide may comprise a drive roller connected to a drive mechanism.

The print head may comprise a cylinder. The print elements may be aligned along a longitudinal axis of the body of the cylinder. The method may comprise rotating the cylinder such that the print elements are arranged to selectively face either the first or second media streams in response to the signal from the processor.

The method may comprise cutting the first media stream at a defined point in the rotation of the cylinder by means of a blade mounted on the cylinder and an anvil mounted on the first media feed mechanism. The blade may comprise a first sharp, cutting edge and a second blunt edge such that the blade is arranged to cooperate with the anvil to cut said media when the cylinder rotates in one direction only. The defined point in the rotation of the cylinder may be at a point in the first feed path after the print head.

The method may comprise locating a further print head on the opposite side of the first media feed path to the print head. The method may comprise printing on the opposite side of the first media stream to the print head using the further print head.

The printer may comprise a yet further print head located on the opposite side of the second media feed path to the print head. The method may comprise printing on the opposite side of the second media stream to the print head using the yet further print head.

The printer head may comprise a thermal print head, comprising thermal print elements. The media may comprise thermal paper. The thermal paper may comprise two sided thermal paper.

BRIEF DESCRIPTION OF THE DRAWINGS

Embodiments of the present invention will now be described, by way of example only, with reference to the accompanying drawings, in which:

FIG. 3*a* is a schematic diagram of a third embodiment of a thermal printer according to an aspect of the present invention;

FIGS. 3*b* and 3*c* are schematic diagrams of media cutting mechanisms applicable to the thermal printer of FIG. 3*a*; and FIG. 4 is a flow chart detailing the steps of thermal printing according to another aspect of the present invention.

DETAILED DESCRIPTION

Figure 1A:
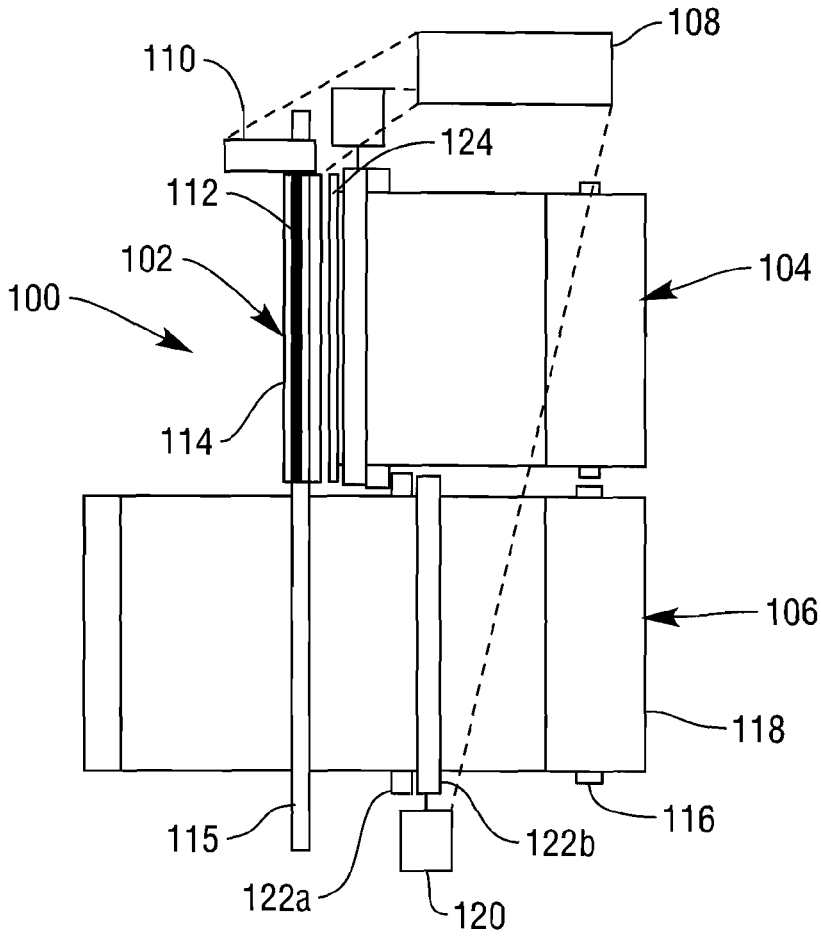
FIG. 1*a* is a schematic diagram of a first embodiment of a thermal printer according to an aspect of the present invention.

Referring now to FIG. 1*a*, an embodiment of a thermal printer 100 comprises a thermal print head 102, first and second media feed mechanisms 104, 106, a control processor 108 and a drive mechanism 110. The control processor 108 controls the thermal print head 102, the first and second media feed mechanisms 104, 106 and the drive mechanism 110. In alternative embodiments an alternative, or additional, control processor may control some or all of the components controlled by the control processor 108.

The thermal print head 102 comprises an array of thermal print elements 112, which operate in a manner known to those skilled in the art, and a body 114. The thermal print head 102 is moveably mounted upon a mounting rail 115.

The first and second media feed mechanisms 104, 106 each comprise a spindle 116 on which is mounted a roll of thermal printer paper 118, a drive motor 120, upper and lower pinch rollers 122*a,b* and a gearing arrangement 124. The upper and lower pinch rollers 122*a,b* engage opposite surfaces of the thermal paper 118. The motor 120 drives the gearing arrangement, which rotates the upper pinch roller 122*b* such that the thermal paper 118 of each of the first and second media feed mechanisms is fed along respective first and second media feed paths past the mounting rail 115. In the present embodiment the first and second media feed mechanisms 104, 106 are arranged such that their respective spindles 116 have a common longitudinal axis and the first and second media feed paths are substantially parallel and coplanar where they pass the mounting rail 115.

The first media feed mechanism 104 comprises a cutting blade (not shown) located in the first media feed path after the mounting rail 115. The cutting blade is arranged to selectively cut the thermal paper 118 of the first media feed mechanism 104 transversely with respect to the direction of travel of the thermal paper 118 along the first media feed mechanism in response to a signal from the control processor 108. The selective cutting of the first media feed mechanism's thermal paper 118 makes the first media feed mechanism 104 suitable for printing customer receipts etc. It will be appreciated that the cutting blade can be located in the first media path prior to the mounting rail 115. Typically, the cutting blade is located on a carriage which moves transversely across the first media path to cut the thermal paper 118 associated therewith. The cutting blade 126 may also be in the form of a guillotine, a spiral rotary cutter, or any other suitable cutting blade. In an alternative embodiment, a rotating "pizza cutter" blade may be mounted on the thermal print head 102.

The drive mechanism 110 drives the thermal print head 102 transversely with respect to the direction of travel of the thermal paper 118 along the first media feed mechanism between first and second printing positions in response to a signal from the control processor 108. In the first printing position the thermal printing elements 112 are located such that printing on to the thermal paper 118 of the first media feed mechanism 104 is allowed. Similarly, in the second printing position the thermal printing elements 112 are located such that printing on to the thermal paper 118 of the second media feed mechanism 106 is allowed.

The drive mechanism 110 can comprise any of a number of alternatives, non-limiting examples of which include; a cooperating drive screw and thread arrangement, a rack and pinion arrangement or a belt drive.

Figure 1B:
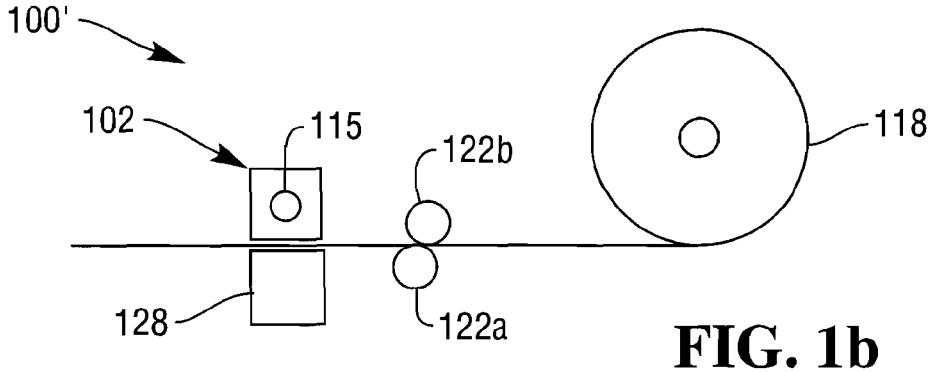
FIGS. 1*b* and 1*c* are partial schematic diagrams of embodiments of paper transport mechanisms and print heads of alternative dual sided printers according to an aspect of the present invention.

Referring now to FIG. 1*b*, a thermal printer 100' corresponds substantially to that shown in FIG. 1*a*, accordingly corresponding parts will be accorded similar reference numerals.

First and second additional thermal print heads 128 are located in the respective first and second media paths such that if the thermal paper 118 is two sided thermal paper printing on both sides of the thermal paper 118 is possible. Usually, the first and second thermal print heads 128 are located opposite the mounting rail 115 although this is not necessarily the case.

It will be further appreciated that if the thermal paper 118 associated with only one of the first and second media feed mechanisms is two sided only a single additional thermal print head, associated with the two sided thermal paper, need be provided.

Figure 1C:
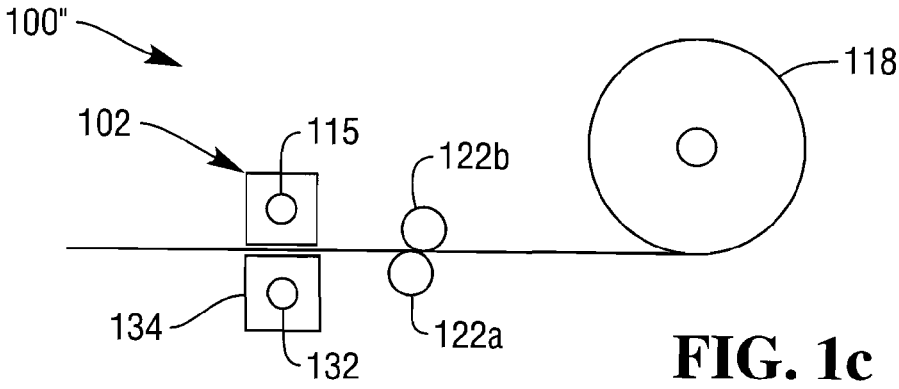

Referring now to FIG. 1*c*, a thermal printer 100" corresponds substantially to that shown in FIG. 1*a*, accordingly corresponding parts will be accorded similar reference numerals.

A second mounting rail 132 is located opposes the mounting rail 115" such that the first and second media feed paths pass therebetween. A second thermal print head 134 is mounted upon the second mounting rail 132. The drive mechanism 110 drives the second thermal print head 134 such that it can print on the thermal paper 118 associated with either the first or second media feed paths 104, 106 in response to a signal from the control processor 108. The second thermal print head 134 can either print on the opposite side of the same thermal paper 118 that the thermal print head 102 is arranged to print on, or can be controlled to print on either thermal paper 118 associated with the first and second media feed mechanisms 104, 106 independently.

It will be appreciated that although described with reference to the thermal print head 102 and the second thermal print head 134 having a common drive mechanism 110 it is envisaged that separate drive mechanisms may be provided for each of them.

Figure 2:
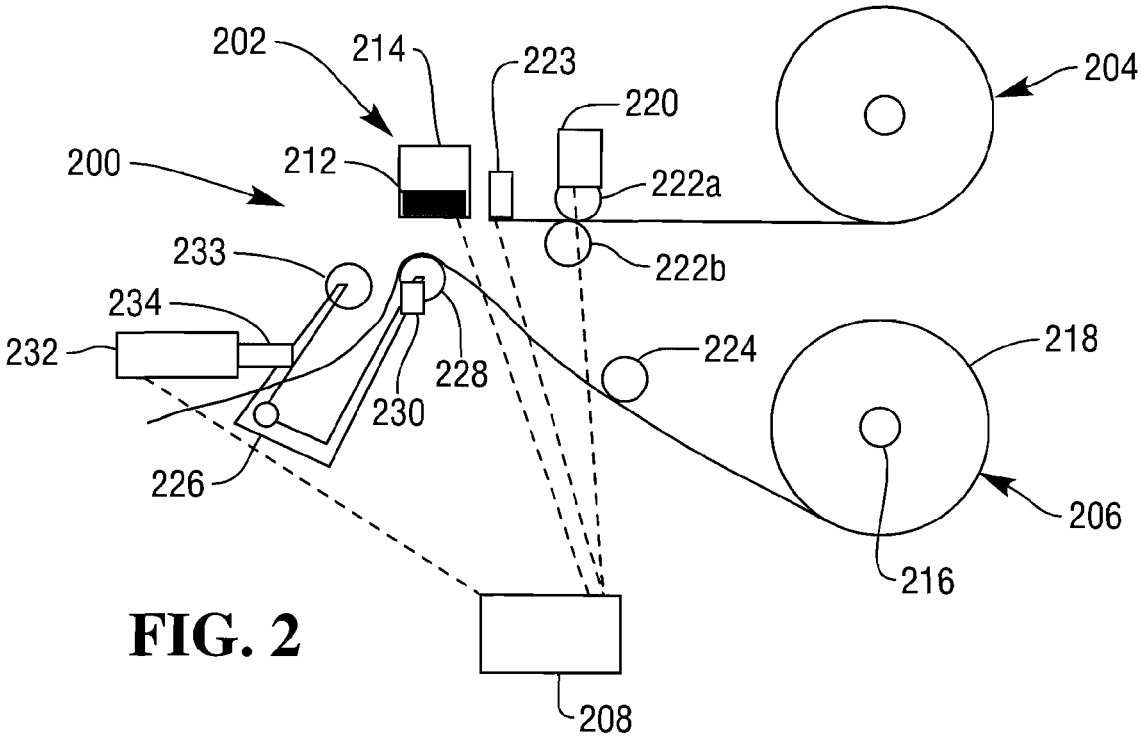
FIG. 2 is a schematic diagram of a second embodiment of a thermal printer according to an aspect of the present invention.

Referring now to FIG. 2, an embodiment of a thermal printer 200 comprises a thermal print head 202, first and second media feed mechanisms 204,206, a control processor 208. The control processor 208 controls the thermal print head 202, the first and second media feed mechanisms 204, 206. In alternative embodiments an alternative, or additional, control processor may control some or all of the components controlled by the control processor 208.

The thermal print head 202 comprises an array of thermal print elements 212, which operate in a manner known to those skilled in the art, and a body 214.

The first and second media feed mechanisms 204, 206 each comprise a spindle 216 on which is mounted a roll of thermal printer paper 218, a drive motor 220.

The first media feed mechanism 204 comprises upper and lower pinch rollers 222*a,b* and a gearing arrangement (not shown). The upper and lower pinch rollers 222*a,b* engage opposite surfaces of the thermal paper 218 associated with the first media feed mechanism 204. The motor 220 drives the gearing arrangement, which rotates the upper pinch roller 222*b* such that the thermal paper 218 of the first media feed mechanisms 204 is fed along a first media feed path past the thermal print head 202. The first media feed mechanism 204 comprises a cutting blade 223 located in the first media feed path prior to the thermal print head 202. The cutting blade 223 is arranged to selectively cut the thermal paper 218 of the first media mechanism 204 in response to a signal from the control processor 208.

The second media feed mechanism 206 comprises a fixed upper pinch roller 224, a pivotally mounted substantially U-shaped arm 226 having a lower drive roller 228 mounted at one free end thereof, a drive motor 230 and an actuating solenoid 232. A support roller 233, which supports media associated with the first media path when it is adjacent the print head, is mounted at the other free end of the arm 226.

In a first state, the first media feed mechanism 204 feeds thermal paper 218 past the print head 202 such that output can be printed on the thermal paper 218. The cutting blade 223 cuts the thermal paper 218 once printing has been completed. The thermal paper 218, typically forming a receipt, has a free end that projects from an opening in a self-service terminal. A customer removes the thermal paper 218 from the self-service terminal by taking the free end of the thermal paper 218. The thermal paper 218 is now terminated prior to the thermal print head 202.

In this first state, the second media feed mechanism 206 is in a rest state, with the actuating solenoid 232 withdrawn such that the arm 226 is in a rest position remote from the print head 202, with the upper and lower pinch rollers 224, 228 adjacent each other on opposite sides of the thermal paper 218. In the present embodiment the drive motor 230 is coupled to lower drive roller 228 such that the thermal paper 218 can be incrementally advanced. It will be appreciated that the drive motor may be coupled to any drive roller or spool after the lower drive roller 228 in the second media feed path.

In the first state, the first and second media feed mechanisms 204, 206 are arranged such that their respective spindles 216 longitudinal axes are displaced relative to each other such that the first and second media feed paths are parallel and lie in different planes from each other such that they are spaced apart from each other.

In response to a signal from the control processor 208 the actuating solenoid 232 withdraws a rod 234 linked to the arm 226. This causes the arm 226 to pivot such that the lower drive roller 228 move towards the print head 202 urging the thermal paper 218 towards the thermal print head 202 as it does so.

In a second state, the lower pinch roller 228 is adjacent the thermal print head 202, such that the thermal print head 202 can print to the thermal paper 218 associated with the second media feed path 206. The thermal paper 218 is supported by the support roller 233. The second state is arrived at by the control processor 208 actuating the solenoid 232 to extends the rod 234 such that the arm 226 pivots and moves the support roller 233 adjacent to the print head 202.

It will be appreciated that although described with reference to a solenoid any suitable drive device can be used to actuate the pivoted arm 226 to move between the first and second states.

It will be appreciated that where two sided thermal paper is used an additional thermal print head can be located in either, or both, of the first and second media feed mechanisms 204, 206 at a point located either before or after the thermal print head 202. This allows printing to the obverse side of the two sided thermal paper to that printed on by the thermal print head 202.

Referring now to FIGS. 3*a-c*, an embodiment of a thermal printer 300 comprises a thermal print head 302, first and second media feed mechanisms 304,306, a control processor 308 and a drive mechanism 310. The control processor 308 controls the thermal print head 302, the first and second media feed mechanisms 304, 306 and the drive mechanism 310. In alternative embodiments an alternative, or additional, control processor may control some or all of the components controlled by the control processor 308.

The thermal print head 302 comprises an array of thermal print elements 312, which operate in a manner known to those skilled in the art, and a cylindrical body 314. The thermal print head 302 is mounted upon an axle 315 such that it can rotate.

The first and second media feed mechanisms 304, 306 each comprise a spindle 316 on which is mounted a roll of thermal printer paper 318, a drive motor 320, upper and lower pinch rollers 322*a,b* and a gearing arrangement (not shown). The upper and lower pinch rollers 322*a,b* engage opposite surfaces of the thermal paper 318. The motor 320 drives the gearing arrangement, which rotates the upper pinch roller 322*a* such that the thermal paper 318 of the respective first and second media feed mechanisms is fed along respective first and second media feed paths past the axle 315. In the present embodiment the first and second media feed mechanisms 304, 306 are arranged such that their respective spindles 316 longitudinal axes are displaced relative to each other such that the first and second media feed paths are parallel and lie in different planes from each other such that they are spaced apart from each other as they pass the thermal print head 302. In the present embodiment, the first and second media feed paths pass the cylindrical body 314 of the thermal print head 302 at diametrically opposing points. However, it will be appreciated that the media paths can pass tangentially to the body 314 at any convenient point.

The first media feed mechanism 304 comprises a cutting blade 326 located in the first media feed path after the axle 315. The cutting blade 326 is arranged to selectively cut the thermal paper 318 of the first media feed mechanism 304 transversely with respect to the direction of travel of the thermal paper 318 along the first media feed mechanism 304 in response to a signal from the control processor 308. It will be appreciated that the cutting blade 326 can be located in the first media path prior to the axle 315. Typically, the cutting blade 326 is located on a carriage which moves transversely across the first media path to cut the thermal paper 318 associated therewith.

The drive mechanism 310 couples with axle 315 of the thermal print head 302 such that the body 314 of the thermal print head 302 rotates about the axle 315 in response to a signal from the control processor 308. The rotation of the body 314 aligns the print elements 312 to print on the thermal paper 318 associated with either the first media feed mechanism 304 or the second media feed mechanism 306.

In one embodiment, the axle 315 rotates in one direction when aligning the print elements 312 to print on one of the streams of thermal paper 318 and in the other direction when aligning the print elements 312 to print on the other stream of thermal paper 318. This arrangement allows for straightforward wiring of the print elements 312 as any twisting of wiring induced when rotating in one direction is undone when rotating in the other direction.

In another embodiment, signals for controlling the operation of the print elements 312 are passed from the control processor 308 via annular contacts mounted upon an end face of the print head's cylindrical body 314 and a mounting post (not shown). This allows rotation of the cylindrical body 314 in only a single direction without the possibility of connecting wires becoming tangled.

It will be appreciated that where two sided thermal paper is used an additional thermal print head can be located in either, or both, of the first and second media feed mechanisms 304, 306 at a point located either at, before or after the thermal print head 302. This allows printing to the obverse side of the two sided thermal paper to that printed on by the thermal print head 302.

In a particular embodiment, shown in FIG. 3*b*, the cutting blade 326 is mounted on the cylindrical body 314 of the print head 302 and interacts with an anvil 328 to cut the media as the cylindrical body 314 rotates. The cutting blade 326 may be spring mounted on the body 314.

In a further development of the embodiment shown in FIG. 3*c*, the cutting blade 326 is retractable into the cylindrical body 314, typically by means of a solenoid 330, such that multiple rotations of the body 314 are possible with the cutting blade 326 retracted prior to selective cutting of the media.

Referring now to FIG. 4, a method of printing on two streams of media comprises feeding first and second media streams past a print head by respective first and second feed mechanisms (Step 400). Relative motion between the print head and the first and second media feed mechanisms is effected in response to a control signal (Step 402*a*). This relative motion varies the location of print elements of the print head such that the print elements face one of either the first or second feed mechanisms dependent upon the control signal from a control processor (Step 402*b*).

It will be appreciated that although described with reference to a thermal printer the present invention is applicable to any type of printer where it is desirable to be able to print to two distinct media streams using a single print head.

It will be appreciated that in all of the above detailed embodiments references to "upper" and "lower" refer to the thermal printer being oriented as shown, if oriented differently than shown other suitable adjectives can be used, for example "left" and "right".

The terms "comprising", "including", "incorporating", and "having" are used herein to recite an open-ended list of one or more elements or steps, not a closed list. When such terms are used, those elements or steps recited in the list are not exclusive of other elements or steps that may be added to the list.

It will be appreciated that although described with reference to an ATM the present invention is applicable to any suitable self-service terminal (SST) or network of SSTs in which multiple print functions can be executed. Examples of suitable SSTs include, but are not limited to: an automated teller machine (ATM); an information kiosk; an electronic funds transfer (EFT) terminal a financial services centre; a video, DVD, multi-media, mpeg3 etc sales/rental kiosk; a bill payment kiosk; a lottery kiosk; a postal services machine; a check-in and/or check-out terminal such as those used in the retail, hotel, car rental, gaming, healthcare, and airline industries; or the like.

It will be further appreciated that non-mutually exclusive elements of differing embodiments of the present invention may be freely interchanged, where applicable.

It will also be appreciated that the steps of the methods described herein may be carried out in any suitable order, or simultaneously where appropriate. The methods described herein may be performed by software in machine readable form on a tangible storage medium or as a propagating signal.

Various modifications may be made to the above described embodiments without departing from the spirit and the scope of the invention.

The invention claimed is:

1. A printer comprising:

a print head comprising a body and print elements;

first and second media feed mechanisms arranged to simultaneously feed respective first and second print media from first and second media rolls along first and second feed paths past the print head to first and second printing positions;

a processor arranged to control the print head and the first and second media feed mechanisms;

a selection mechanism for selecting one of the first and second print media for printing, the selection mechanism arranged to effect relative motion between the print head body and at least one of the first and second media feed mechanisms in response to a signal from the processor; and the print elements being arranged to selectively face a respective printing position of either the first or second feed mechanism dependent upon the signal from the processor.

2. The printer of claim 1, wherein the first and second media feed mechanisms are aligned such that the respective paths of media fed therethrough lie in a common plane parallel to the direction of feed of said media.

3. The printer of claim 1, wherein the selection mechanism comprises a drive mechanism arranged to drive the print head transversely to the feed paths between first and second positions corresponding to the first and second feed paths respectively.

4. The printer of claim 1, wherein the first and second media feed mechanisms are aligned such that the respective paths of media fed therethrough lie in separate parallel planes, which are also parallel to the direction of feed of said media.

5. The printer of claim 4, wherein the first media feed path is closer to the print head than the second media feed path.

6. The printer of claim 4, wherein the selection mechanism comprises a displacement mechanism arranged to displace the second media feed path such that media fed along the second media feed path is adjacent the print elements.

7. The printer of claim 6, wherein the displacement mechanism comprises a pivotally mounted arm having a guide arranged to support media associated with the second media feed path at a free end thereof.

8. The printer of claim 7, wherein the displacement mechanism comprises a motor arranged to drive the arm between first and second positions in response to a signal from the processor, wherein in the first position the guide is remote from the print head and in the second position the guide is adjacent the print head.

9. The printer of claim 1, wherein the print head comprises a cylinder and wherein the displacement mechanism is arranged to rotate the cylinder such that the print elements are arranged to selectively face a respective feed path of either the first or second feed mechanism in response to the signal from the processor.

10. The printer of claim 1, comprising a further print head located on the opposite side of the first media feed path to the print head, wherein the further print head is arranged to print on the opposite side of media passing along the first media feed path to the print head.

11. The printer of claim 1, comprising a yet further print head located on the opposite side of the second media feed path to the print head, wherein the yet further print head is arranged to print on the opposite side of media passing along the second media feed path to the print head.

12. The printer of claim 1, comprising a cutting device associated with the first media feed mechanism, wherein the cutting device is arranged to cut media fed through the first media feed mechanism transversely to the direction of feed of the first media feed mechanism, in response to a signal from the processor.

13. The printer of claim 1, wherein the printer head comprises a thermal print head, comprising thermal print elements.

14. The printer of claim 13, wherein the media comprises thermal paper.

15. The printer of claim 14, wherein the thermal paper comprises two sided thermal paper.

16. A self-service terminal comprising a printer according to claim 1.

17. The self-service terminal of claim 16, wherein the self-service terminal comprises any of the following: an automated teller machine ATM; an information kiosk; an electronic funds transfer (EFT) terminal a financial services centre; a video, DVD, multi-media, mpeg3 etc sales/rental kiosk; a bill payment kiosk; a lottery kiosk; a postal services machine; a check-in and/or check-out terminal such as those used in the retail, hotel, car rental, gaming, healthcare, and airline industries; or the like.

18. A method of printing on two streams of media comprising the steps of:

simultaneously feeding first and second media streams along first and second feed paths past a print head to first and second printing positions by respective first and second feed mechanisms; and effecting relative motion between the print head and the first and second media feed mechanisms in response so as to vary the location of print elements of the print head such that the print elements face one of either the first or second printing positions dependent upon the signal from a control processor.

19. The printer of claim 18, wherein the printer head comprises a thermal print head, comprising thermal print elements.

20. The printer of claim 19, wherein the media comprises thermal paper.

21. The printer of claim 20, wherein the thermal paper comprises two sided thermal paper.

22. A printer comprising:

a print head comprising a body and print elements;

first and second media feed mechanisms arranged to feed respective first and second print media past the print head;

a processor arranged to control the print head and the first and second media feed mechanisms;

a selection mechanism arranged to effect relative motion between the print head body and at least one of the first and second media feed mechanisms in response to a signal from the processor; and the print elements being arranged to selectively face a respective feed path of either the first or second feed mechanism dependent upon the signal from the processor;

wherein the print head comprises a cylinder and wherein the displacement mechanism is arranged to rotate the cylinder such that the print elements are arranged to selectively face a respective feed path of either the first or second feed mechanism in response to the signal from the processor.

23. A printer comprising:

a print head comprising a body and print elements;

first and second media feed mechanisms arranged to feed respective first and second print media past the print head;

a processor arranged to control the print head and the first and second media feed mechanisms;

a selection mechanism arranged to effect relative motion between the print head body and at least one of the first and second media feed mechanisms in response to a signal from the processor; and the print elements being arranged to selectively face a respective feed path of either the first or second feed mechanism dependent upon the signal from the processor;

wherein the first and second media feed mechanisms are aligned such that the respective paths of media fed therethrough lie in separate parallel planes, which are also parallel to the direction of feed of said media;

wherein the selection mechanism comprises a displacement mechanism arranged to displace the second media feed path such that media fed along the second media feed path is adjacent the print elements, including a pivotally mounted arm having a guide arranged to support media associated with the second media feed path at a free end thereof and a motor arranged to drive the arm between first and second positions in response to a signal from the processor, wherein in the first position the guide is remote from the print head and in the second position the guide is adjacent the print head.

* * * * *